US005417510A

United States Patent [19]

Stout

[11] Patent Number: 5,417,510

[45] Date of Patent: May 23, 1995

[54] BOOK BINDING WITH SEMI-CONCEALED WIRE ELEMENTS

[75] Inventor: Mark A. Stout, Crawfordsville, Ind.

[73] Assignee: R. R. Donnelley & Sons Company, Chicago, Ill.

[21] Appl. No.: 188,152

[22] Filed: Jan. 27, 1994

[51] Int. Cl.[6] ..... B42F 13/00

[52] U.S. Cl. ..... 402/76; 402/57; 402/73; 281/21.1; 281/27.1; 281/37

[58] Field of Search ..... 402/57, 70, 73, 76, 402/77, 80 R, 80 L, 79; 281/15.1, 19.2, 21.1, 27.1, 27, 36, 37

[56] References Cited

U.S. PATENT DOCUMENTS

| | | | |
|---|---|---|---|
| 4,711,469 | 12/1987 | Bogare | 281/15.1 X |
| 4,811,973 | 3/1989 | Kumar-Misir | 402/79 X |
| 4,907,905 | 3/1990 | Fournier | 402/80 R |

*Primary Examiner*—Willmon Fridie

*Attorney, Agent, or Firm*—Arnold, White & Durkee

[57] ABSTRACT

A book binding comprises a hard cover and a plurality of wire elements connected to the hard cover. The hard cover includes a front side, a back side, and a backbone bridging the front and back sides. The back side includes a plurality of pairs of apertures located adjacent and generally parallel to the backbone. The back side further includes a hinge spaced slightly away from the backbone and extending from a top edge to a bottom edge of the back side. The hinge is positioned between the plurality of pairs of apertures such that one aperture in each of the pairs of apertures is located on one side of the hinge and the other aperture in each of the pairs of apertures is located on the other side of the hinge. Each of the wire elements engages an associated pair of the plurality of pairs of apertures such that an arc-like section of each of the wire elements is located adjacent an outer surface of the back side.

6 Claims, 4 Drawing Sheets

BOOK BINDING WITH SEMI-CONCEALED WIRE ELEMENTS

FIELD OF THE INVENTION

The present invention generally relates to book bindings having closed wire elements for holding the pages of books together. More particularly, the present invention relates to a book binding having a plurality of semi-concealed wire elements extending through apertures in the back side of a hard cover.

BACKGROUND OF THE INVENTION

In one type of book binding, the binding includes a hard cover having a front side, a back side, and a backbone bridging the front and back sides. When the binding is in a closed position, the front and back sides are positioned generally parallel to one another and the backbone extends generally perpendicular to the front and back sides. The binding further includes a plurality of circular wire elements which, when the binding is in the closed position, may be either fully concealed or partially concealed by the hard cover.

In a binding with fully concealed wire elements, the inner surface of the hard cover is lined with paperboard. The paperboard substantially covers the inner surfaces of the front side, the back side, and the backbone of the hard cover, and the paperboard is adhered to the inner surfaces of the front and back sides by means such as glue. The paperboard is not adhered to the inner surface of the backbone, but rather remains separated therefrom by a small gap, so that the wire elements may be attached to the hard cover using the strip of paperboard located adjacent the backbone. More specifically, each circular wire element passes through an associated pair of adjacent apertures in the strip of paperboard such that an arc-like section of the wire element is positioned within the small gap between the paperboard and the backbone. The wire elements are "fully concealed" by the hard cover because they are located entirely within the interior thereof. The wire elements do not pass from the interior to the exterior of the hard cover.

In a binding with semi-concealed wire elements, the paperboard is adhered to the inner surfaces of the front side, back side, and the backbone so that no small gap exists between the paperboard and the backbone. Each wire element is attached to the hard cover by passing the wire element through an associated pair of adjacent apertures in the backbone itself such that an arc-like section of the wire element is located outside the hard cover adjacent the outer surface of the backbone.

In comparing the foregoing two bindings, an advantage of the binding with fully-concealed wire elements is that it permits writing or labels to be placed on the backbone without interference from the wire elements. Another advantage of the binding with fully-concealed wire elements is that it has a nicer appearance than the binding with semi-concealed wire elements because the wire elements in the former binding are hidden from view when the binding is in the closed position. The binding with semi-concealed wire elements, however, has the advantage that it is less expensive to manufacture than the binding with fully-concealed wire elements.

Accordingly, a need exists for a book binding which utilizes the advantages of both the foregoing binding with fully-concealed wire elements and the foregoing binding with semi-concealed wire elements.

SUMMARY OF THE INVENTION

In accordance with the foregoing, an object of the present invention is to provide a book binding which permits writing or labels to be placed on the backbone without interference from the wire elements.

Another object of the present invention is to provide a book binding which substantially conceals the wire elements from view by passing the wire elements through respective pairs of apertures in the back side of the hard cover instead of the backbone of the hard cover.

Yet another object of the present invention is to provide a book binding which is less expensive to manufacture than the foregoing binding with fully-concealed wire elements.

In accordance with the present invention, the foregoing objects are realized by providing a book binding comprising a hard cover and a plurality of wire elements connected to the hard cover. The hard cover includes a front side, a back side, and a backbone bridging the front and back sides. The back side is provided with a plurality of pairs of apertures located adjacent the backbone of the hard cover. Each of the wire elements engages an associated pair of the plurality of pairs of apertures to connect the wire elements to the back side of the hard cover.

BRIEF DESCRIPTION OF THE DRAWINGS

Other objects and advantages of the invention will become apparent upon reading the following detailed description and upon reference to the accompanying drawings, in which.

Figure 1:
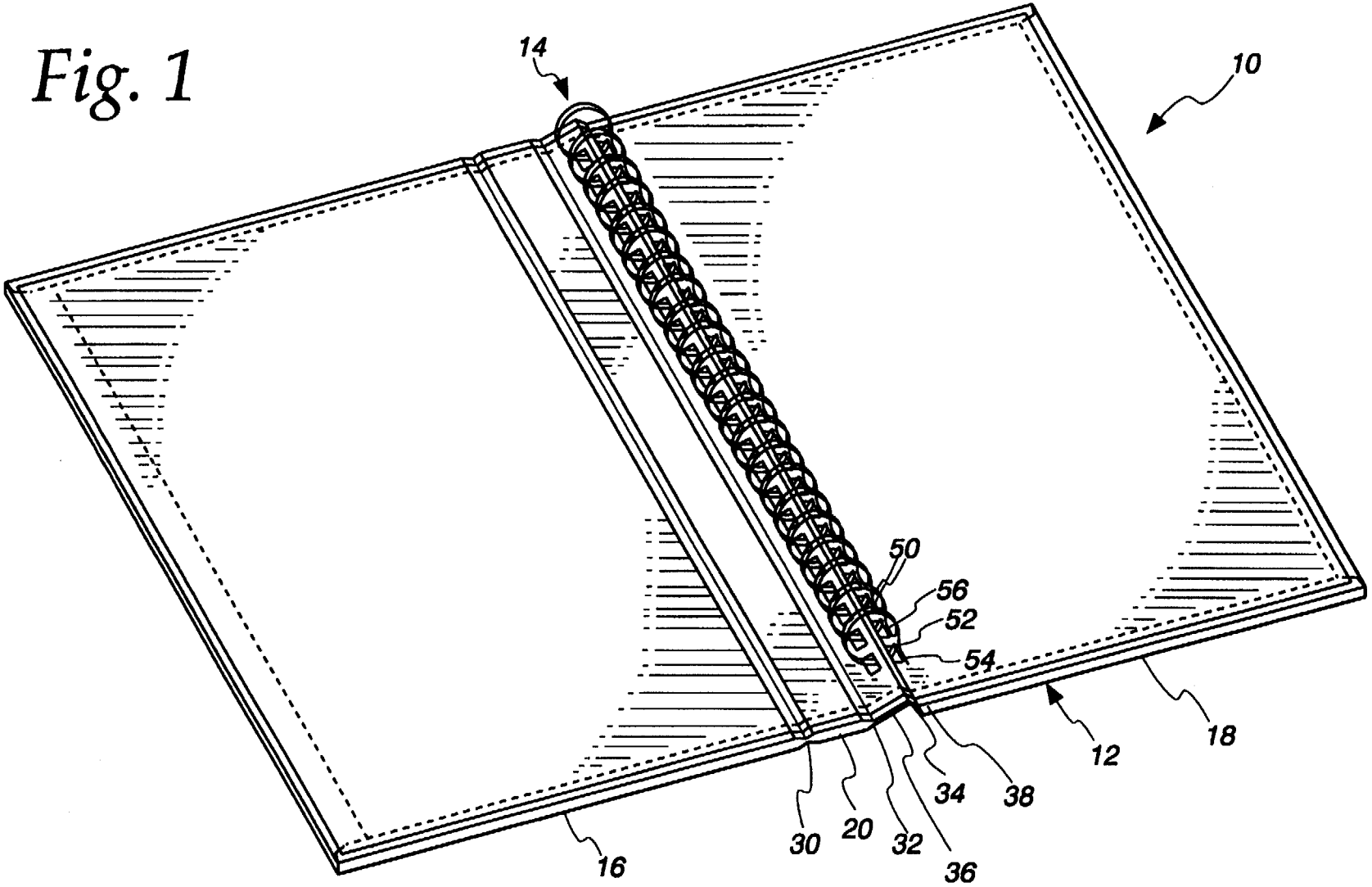
FIG. 1 is a perspective view of the book binding embodying the present invention, the book binding being shown in an open position without a book connected thereto.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Turning now to the drawings, FIGS. 1–5 illustrate a book binding 10 including a rectangular hard cover 12 and a plurality of circular wire elements 14. The hard cover 12 is integrally formed from a front side 16, a back side 18, and a backbone 20 bridging the front and back sides 16, 18.

Figure 5:
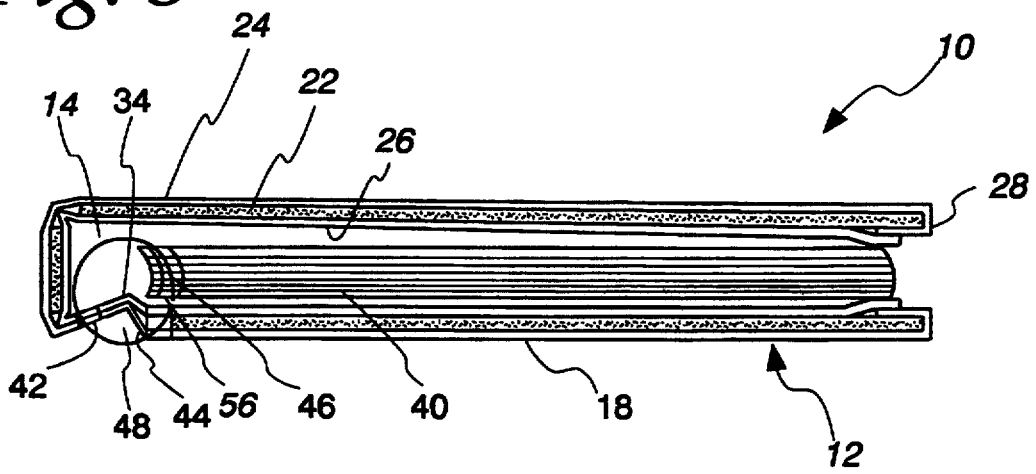
FIG. 5 is a section taken generally along the line 5—5 in FIG. 3.

Since the process for manufacturing the hard cover 12 is conventional, it will not be described in detail herein. It suffices to say that the hard cover 12 is composed of a base layer of hard cardboard 22 which is lined on its outer surface with laminated paper 24 and is lined on its inner surface with paperboard 26 (FIG. 5). The laminated paper 24 and the paperboard 26 are bonded to their respective surfaces of the hard cardboard 22 by adhesive means such as glue. Furthermore, since the laminated paper 24 is slightly longer and wider than the outer surface of the hard cardboard 22, the peripheral sides 28 of the laminated paper 24 are folded about associated edges of the cardboard 22 and bonded to the inner surface thereof beneath the periphery of the paperboard 26 (FIG. 5). Thus, at the periphery of the hard cover 12, the cardboard 22 is covered on its inner surface by the laminated paper 24 and the paperboard 26 and is covered on its outer surface by the laminated paper 24.

To permit the hard cover 12 to move between an open position (FIGS. 1–2) and a closed position (FIGS. 3–4), the hard cover 12 is provided with three parallel hinges 30, 32, and 34. These hinges result from the division of the cardboard 22 of the hard cover 12 into three distinct pieces. More specifically, one rectangular piece of cardboard is used to form the front side 16 of the hard cover 12, a second rectangular piece of cardboard is used to form the backbone 20, and a third rectangular piece of cardboard is used to form most of the back side 18. The edge of this third rectangular piece of cardboard is actually positioned a short distance (e.g, 0.5 inches) away from the backbone 20 so that a strip section 36 of the backside 18 is composed only of the laminated paper 24 and the paperboard 26.

The junction between the front side cardboard and the backbone cardboard forms the hinge 30, the junction between the backbone cardboard and the strip section 36 forms the hinge 32, and the junction between the strip section 36 and a second section 38 of the backside 18 forms the hinge 34. The hinges 30, 32, and 34 extend from the top edge to the bottom edge of the hard cover 12 and are disposed parallel to the side edges of the hard cover 12.

Figure 3:
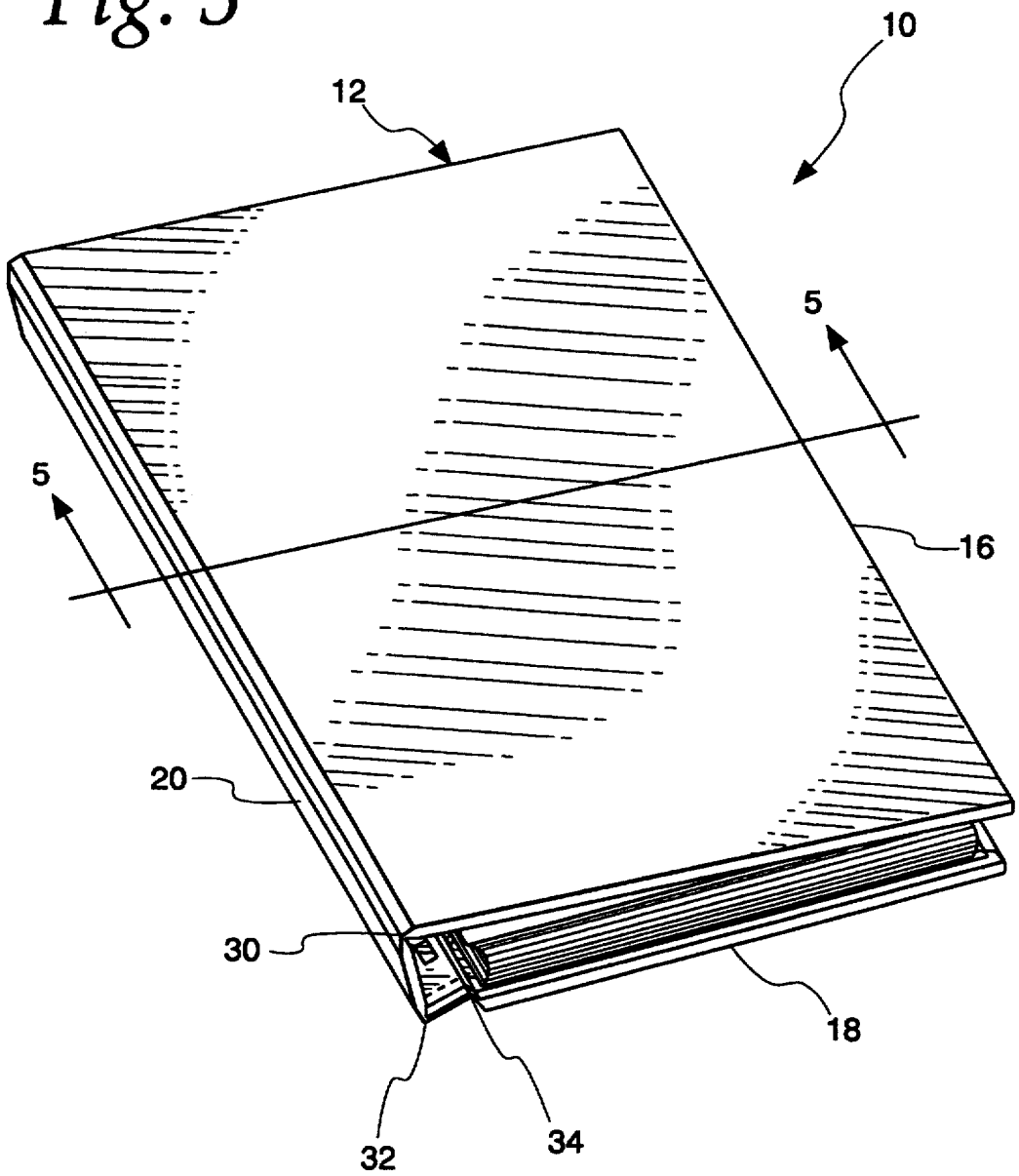
FIG. 3 is a perspective view of the book binding in FIG. 1 showing front side of a hard cover of the binding.
Figure 4:
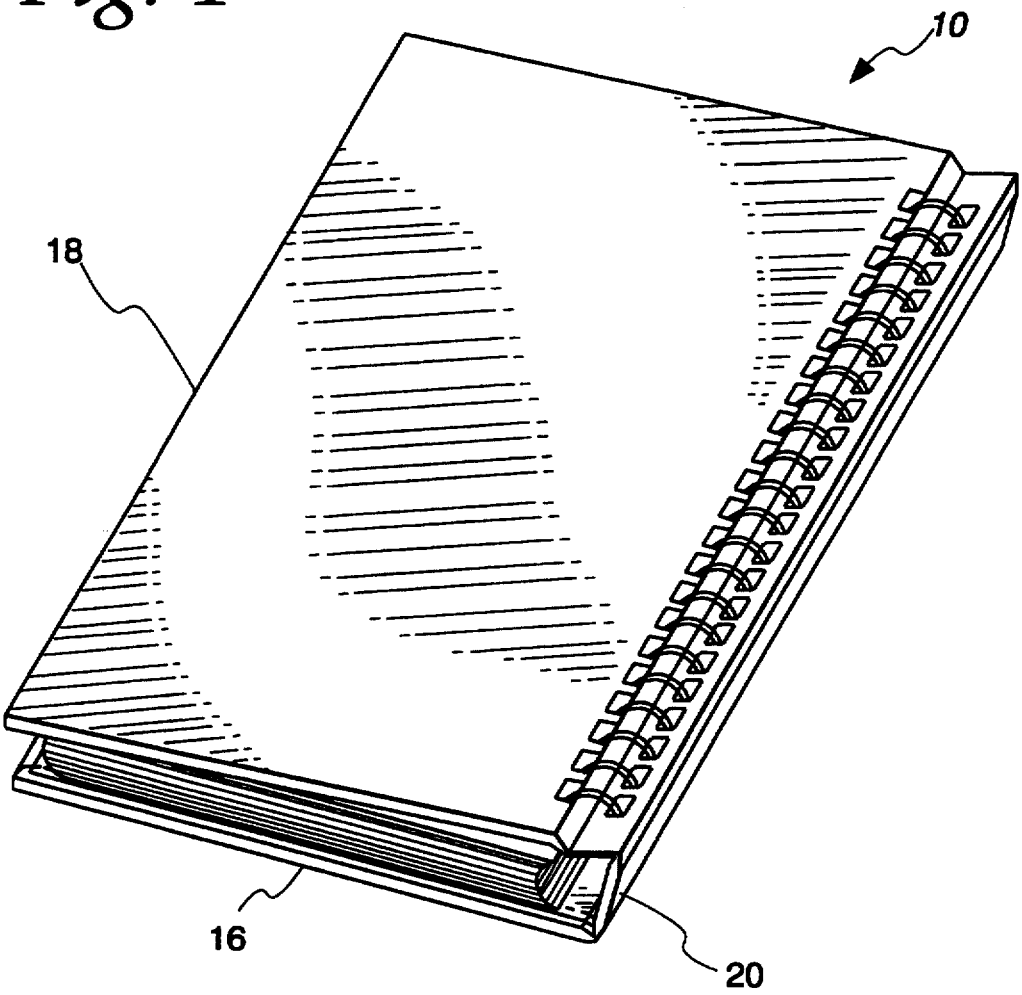
FIG. 4 is a perspective view of the book binding in FIG. 1 showing a back side of the hard cover of the binding.

When the hard cover 12 moves between the open position (FIGS. 1–2) and the closed position (FIGS. 3–4), the two hard cover sections adjacent each of the hinges 30, 32, and 34 are rotated relative to one another about their respective hinge. In particular, the front side 16 and the backbone 20 rotate relative to one another about the hinge 30 from the open position (FIGS. 1–2) to the closed position (FIGS. 3–4). In the open position the inner surface of the front side 16 is oriented approximately 180 degrees away from the inner surface of the backbone 20, while in the closed position the inner surface of the front side 16 is approximately perpendicular to the inner surface of the backbone 20. Similarly, the back side 18 and the backbone 20 rotate relative to one another about the hinge 32 from the open position (FIGS. 1–2) to the closed position (FIGS. 3–4). As with the hinge 30, in the open position the inner surface of the back side 18 is oriented approximately 180 degrees away from the inner surface of the backbone 20, while in the closed position the inner surface of the back side 18 is approximately perpendicular to the inner surface of the backbone 20.

With respect to the hinge 34, its two adjacent sections 36, 38 of the back side 18 slightly rotate relative to one another about the hinge 34 in an opposite direction relative to the rotations permitted by the respective hinges 30, 32. In the closed position the inner surface of the back side section 36 is oriented approximately 180 degrees away from the inner surface of the back side section 38, while in the open position the inner surface of the back side section 36 is oriented greater than 180 degrees (e.g., 200 degrees) away from the inner surface of the back side section 38.

Figure 2:
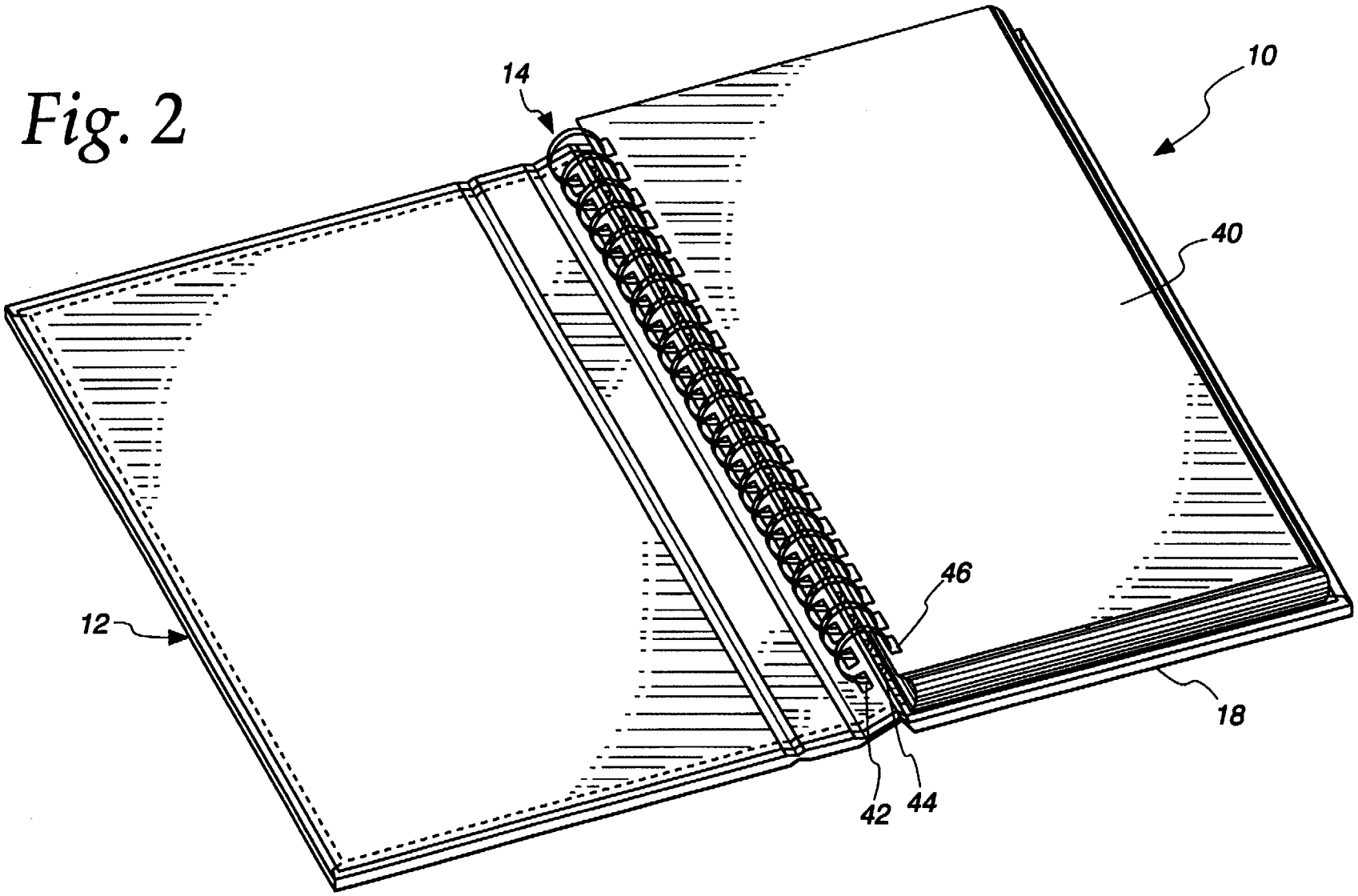
FIG. 2 is a perspective view of the book binding in FIG. 1, the book binding being shown in the open position with a book connected thereto.

The circular wire elements 14 are used to connect a book 40 to the back side 18 of the hard cover 12 (FIG. 2). Each of the wire elements 14 is connected to the hard cover 12 by a respective pair of adjacent apertures 42, 44 in the back side 18 thereof and is connected to the book 40 by a respective aperture 46 extending through all the pages of the book 40. The two apertures 42, 44 in each pair, as well as the aperture 46 associated with that pair, are located the same distance from the top edge (or bottom edge) of the back side 18. The apertures 42 are located along the back side section 36, while the apertures 44 are located along the back side section 38. In addition, the apertures 42 are parallel to the apertures 44.

As best shown in FIG. 5, each of the wire elements 14 forms a circular path extending from the interior of the hard cover 12, through the aperture 44 to the exterior of the hard cover 12, back through the aperture 42 to the interior of the hard cover 12, and through the aperture 46 in the book 40. Thus, an arc-like section 48 of the wire element 14 is located outside the hard cover 12 adjacent the back side 18 thereof. To prevent the hard cover 12 from "rolling" clockwise around the wire elements 14 (as viewed in FIG. 5), the apertures 42, 44 are arranged on opposite sides of the hinge 34 so that the ends of the arc-like section 48 are, in turn, located on opposite sides of the hinge 34. When the binding 10 is in the closed position, the back side sections 36, 38 bend relative to one another about the hinge 34 to accommodate the stress placed on the back side 18 by virtue of the passage of the wire elements 14 through the apertures 42, 44. To further prevent the hard cover 12 from "rolling" clockwise around the wire elements 14, the apertures 44 are formed in the edge of the cardboard located in the back side 18 of the hard cover 12. Since the strip section 36 is not composed of any cardboard, the strip section 36 permits flexible movement about the hinges 32, 34 and further relieves the stress placed on the back side 18 by the wire elements 14.

The circular wire elements 14 are preferably manufactured from a unitary piece of formed wire configured as best illustrated in FIG. 1. Each of the wire elements 14 includes a pair of parallel circular wires 50 which are integrally connected at one end 52 and are separated from one another at the other end 54. Each of the separated ends 54 of the pair of circular wires 50 is connected to the separated end of an adjacent circular wire by a linear wire member 56. Each of the linear wire members 56 links together an adjacent pair of the wire elements 14.

In FIG. 5, the location of the linear wire members 56 relative to the book 40 and the hard cover 12 is indicated by the reference numeral 56'. Since the linear wire members 56 are angularly positioned between the back side 18 of the hard cover 12 and the last page of the book 40, the linear wire members 56 limit the allowable rotational movement of the wire elements 14 relative to the hard cover 12. Since in the closed position of the binding 10 the last page of the book 40 abuts against the inner surface of the back side 18, the linear wire members 56 are "sandwiched" between the last page of the book 40 and the inner surface of the back side 18. Therefore, in the closed position the wire elements 14 are rotationally positioned in accordance with this fixed position of the linear wire members 56.

It can be seen from the foregoing detailed description that since the arc-like sections 48 of the wire elements 14 are located adjacent the back side 18 of the hard cover 12, the binding 10 permits writing or labels to be placed on the backbone 20 without interference from the wire elements 14. Furthermore, the binding 10 has a nice appearance because the arc-like sections 48 are substantially concealed from view in the typical viewing perspective depicted in FIG. 3. Moreover, the binding 10 is relatively inexpensive to manufacture because the wire elements 14 are only partially concealed.

What is claimed is:

1. A book binding, comprising:

a hard cover having a front side, a back side, and a backbone bridging said front and back sides, said back side having a plurality of pairs of apertures located adjacent and generally parallel to said backbone; and a plurality of wire elements connected to said back side of said hard cover, each of said wire elements engaging an associated pair of said plurality of pairs of apertures such that a portion of each of said wire elements is located adjacent an outer surface of said back side.

2. The book binding of claim 1, wherein said back side includes a hinge spaced slightly away from said backbone and extending from a top edge to a bottom edge of said back side, said hinge positioned between said plurality of pairs of apertures such that one aperture in each of said pairs of apertures is located on one side of said hinge and the other aperture in each of said pairs of apertures is located on the other side of said hinge.

3. The book binding of claim 1, wherein said wire elements are circular such that said portion of each of said wire elements is an arc-like section.

4. The book binding of claim 2, wherein said hinge divides said back side into a strip-shaped first section and a second section, and wherein said first section is free of cardboard to facilitate movement of said second section relative to said first section about said hinge.

5. A book binding, comprising:

a hard cover having a front side, a back side, and a backbone bridging said front and back sides, said back side having a plurality of pairs of apertures located adjacent and generally parallel to said backbone, said back side including a hinge spaced slightly away from said backbone and extending from a top edge to a bottom edge of said back side, said hinge positioned between said plurality of pairs of apertures such that one aperture in each of said pairs of apertures is located on one side of said hinge and the other aperture in each of said pairs of apertures is located on the other side of said hinge; and a plurality of circular wire elements connected to said back side of said hard cover, each of said wire elements engaging an associated pair of said plurality of pairs of apertures such that an arc-like section of each of said wire elements is located adjacent an outer surface of said back side.

6. The book binding of claim 5, wherein said hinge divides said back side into a strip-shaped first section and a second section, and wherein said first section is free of cardboard to facilitate movement of said second section relative to said first section about said hinge.

* * * * *